US009144294B2

(12) United States Patent
Gregory et al.

(10) Patent No.: US 9,144,294 B2
(45) Date of Patent: Sep. 29, 2015

(54) ATTACHMENT SYSTEMS

(75) Inventors: Stuart Douglas Gregory, Llandulas (GB); Paul Alan Oliver, Rhyl (GB); Richard Craig Griffin, Ruthin (GB)

(73) Assignee: SURVITEC GROUP LIMITED (GB)

( * ) Notice: Subject to any disclaimer, the term of this patent is extended or adjusted under 35 U.S.C. 154(b) by 338 days.

(21) Appl. No.: 13/125,275

(22) PCT Filed: Oct. 23, 2009

(86) PCT No.: PCT/GB2009/002538

§ 371 (c)(1),
(2), (4) Date: Apr. 20, 2011

(87) PCT Pub. No.: WO2010/046664

PCT Pub. Date: Apr. 29, 2010

(65) Prior Publication Data

US 2011/0191933 A1 Aug. 11, 2011

(30) Foreign Application Priority Data

Oct. 24, 2008 (GB) ..... 0819596.8
Jun. 18, 2009 (GB) ..... 0910534.7

(51) Int. Cl.
*A45C 15/00* (2006.01)
*A45F 5/02* (2006.01)
(Continued)

(52) U.S. Cl.
CPC ..... *A45F 5/02* (2013.01); *A41D 13/0012* (2013.01); *A45F 3/04* (2013.01); *A45F 3/14* (2013.01); *F41H 1/02* (2013.01); *A41D 2300/33* (2013.01)

(58) Field of Classification Search
CPC ..... A45F 3/04; A45F 3/14; A45C 15/00
USPC ..... 224/675, 579, 578, 580, 583, 665, 672; 24/3.7, 3.5, 3.9; 2/102
See application file for complete search history.

(56) References Cited

U.S. PATENT DOCUMENTS 5,259,093 A 11/1993 D'Annunzio
5,724,707 A * 3/1998 Kirk et al. ..... 24/3.7
(Continued)

FOREIGN PATENT DOCUMENTS

FR 2 753 054 3/1998
WO 97/48302 12/1997
(Continued)

OTHER PUBLICATIONS

Search Report dated Sep. 28, 2009 issued in connection with related United Kingdom Patent Application No. GB0910534.7 (1 pg.).

*Primary Examiner* — Justin Larson
*Assistant Examiner* — Lester L Vanterpool
(74) *Attorney, Agent, or Firm* — Maschoff Brennan

(57) ABSTRACT

An attachment system principally use on garment (10, 30) provides a number of aligned loops (15) on the garment and a number of aligned loops (24) on a load such as an equipment pack (17). The load also includes an elongate securing member that extends from the load with a flexible proximal portion (26) and a stiffened distal portion (27). The stiffened distal portion (27) can be very readily threaded through successive ensemble loops (15) and load loops (24) to pull the flexible proximal portion (26) through the loops (15, 24) to attach the load (17) to the garment (10, 30). The stiffened distal portion (27) is then fed back through the loops (15, 24) to provide a geometric lock that prevents the load (17, 18) detaching from the garment (10, 30). Various loads can be attached in this way.

21 Claims, 6 Drawing Sheets

Figure 1:
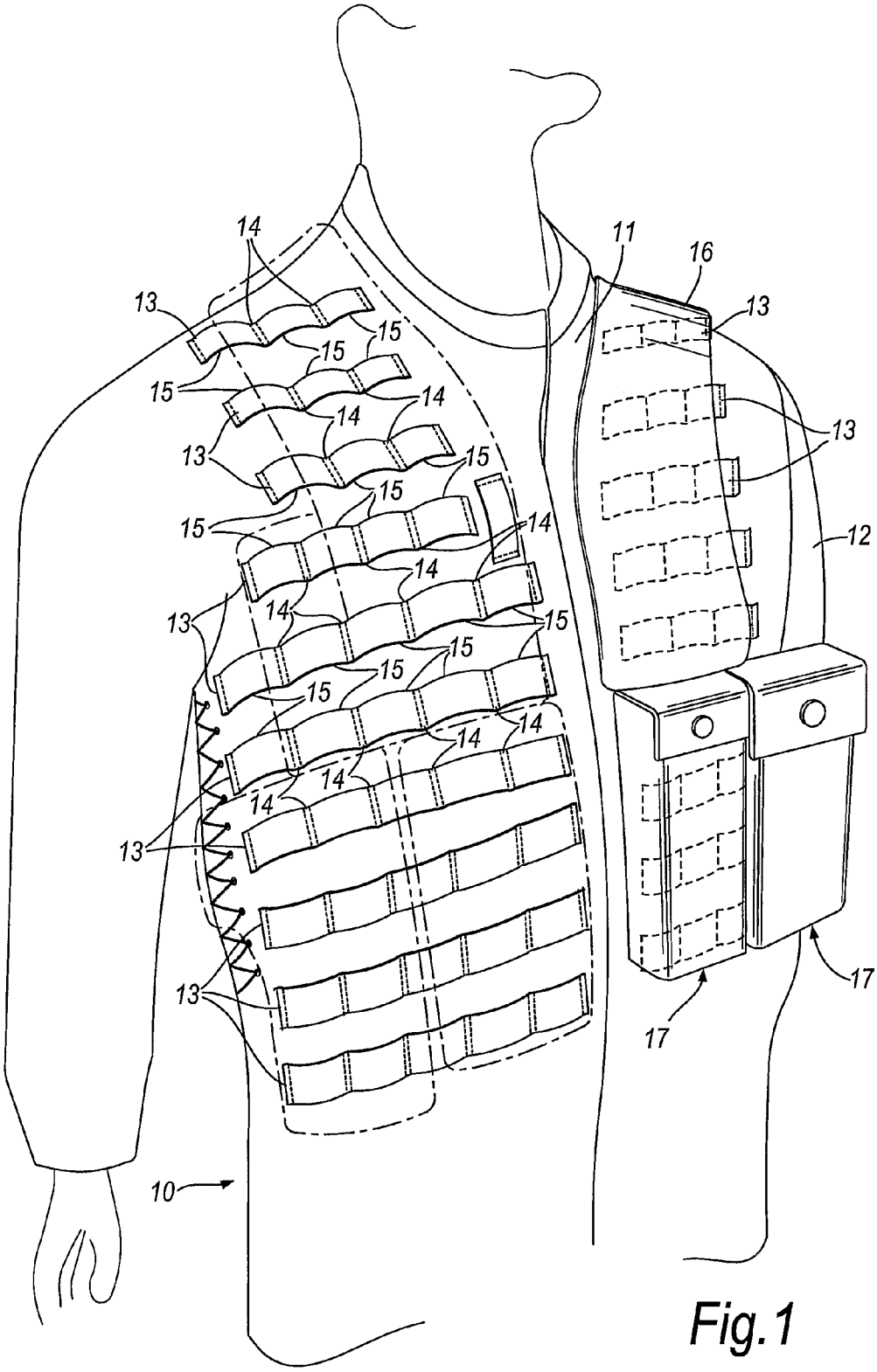

(51) Int. Cl.

| | |
|---|---|
| ***A45F 3/04*** | (2006.01) |
| ***A45F 3/14*** | (2006.01) |
| ***A41D 13/00*** | (2006.01) |
| ***F41H 1/02*** | (2006.01) |

(56) References Cited

U.S. PATENT DOCUMENTS

| | | | | |
|---|---|---|---|---|
| 6,279,804 | B1 * | 8/2001 | Gregg | 224/675 |
| 7,047,570 | B2 * | 5/2006 | Johnson | 2/102 |
| 7,080,430 | B2 * | 7/2006 | Wemmer | 24/578.13 |
| 7,240,404 | B2 * | 7/2007 | Flossner | 24/3.7 |
| 7,490,358 | B1 * | 2/2009 | Beck | 2/2.5 |
| 7,694,862 | B2 * | 4/2010 | Bergeron | 224/665 |
| 7,963,427 | B2 * | 6/2011 | Calkin | 224/675 |
| 8,002,159 | B2 * | 8/2011 | Cragg | 224/579 |
| 8,240,532 | B2 * | 8/2012 | Cragg | 224/648 |
| 2005/0005342 | A1 | 1/2005 | Johnson | |
| 2005/0015944 | A1 | 1/2005 | Bergeron | |
| 2006/0113344 | A1 | 6/2006 | Cragg | |
| 2007/0158380 | A1 | 7/2007 | Calkin | |
| 2007/0289045 | A1 | 12/2007 | Evans et al. | |
| 2008/0257922 | A1 | 10/2008 | Cragg | |

FOREIGN PATENT DOCUMENTS

| | | |
|---|---|---|
| WO | 2006/116952 | 11/2006 |
| WO | 2007/111981 | 10/2007 |

* cited by examiner

ATTACHMENT SYSTEMS

The invention relates to attachment systems and in particular attachment systems for connecting a load to a support surface.

One form of attachment system comprises of a support surface provided with a plurality of spaced aligned loops and a load provided with a plurality of spaced aligned loops, each load loop being between two adjacent support surface loops and an elongate flexible securing member extending from the load and being passed through successive support surface and load loops to mount the load on the support surface. One example of such an attachment system for use in military operations (the so-called MOLLE system) utilises webbing to form the loops and the elongate securing member. The support surface is, for example, a surface of an upper body garment and webbings extend circumferentially around the garment at spaced vertical positions. The webbings are connected to the garment with the points of connection spaced by about 20 mm to provide along each webbing a succession of loops with the loops of one webbing aligned with the loops of the next adjacent webbing or webbings. The load has parallel spaced bands of webbing on a surface of the load with the webbings attached to the load at similar 20 mm intervals to form rows of aligned loops.

The spacing between the webbing rows on the garment and the webbing rows on the load are at least equal to the widths of the webbings so that, when the load surface is placed against the garment, each load webbing lies between and parallel to two adjacent garment webbings.

When in this position, the elongate securing webbing on the load is threaded through a path formed by successive garment loops and load loops until it has passed the last load loop.

It is a disadvantage of such an arrangement that, since the webbing is flexible and not self-supporting, it is not easy to guide it through the loops. In use and in wear, the webbings become distorted and even more soft and pliable and this makes the threading difficult.

According to a first aspect of the invention, there is provided an attachment system comprising a support surface provided with a plurality of spaced aligned loops, and a load provided with a plurality of spaced aligned loops, the load loops and the support loops being arranged in an aligned succession to define a path through the loops, and an elongate securing member extending from the load and having a flexible proximal portion and a stiffened distal portion extending from the proximal portion to a free end, the free end of the distal portion being passed through successive support surface loops and load loops along said path in a first direction with the length of the distal portion being such that the free end of the distal portion emerges from the path before the proximal portion enters the path, the free end allowing the proximal portion to be drawn through said loops in said first direction, to secure the load on the support surface.

The provision of the long stiffened distal portion makes it easy to pass the securing member through the loops.

It is known to provide the webbing that is fed through the loops with a press stud or some other fastening to allow the end of the webbing to be secured to the load or the garment to prevent the free end of the webbing from pulling back and becoming unlaced. This is also a disadvantage because the fastening makes it more difficult to thread the webbing through the loops and will have a tendency to snag on the loops during threading. In addition, the use of a fastening is disadvantageous because it can be liable to damage and can be susceptible to being pulled undone. Damage may occur, for example, if the load is laundered. It is not easy to secure the fastener in unfavourable conditions and it is sometimes difficult to know whether the webbing is definitely secured or not.

Another form of fastening uses a reverse barb which acts to catch on the loops to stop the securing webbing becoming unthreaded. If, however, the load needs to be removed, this barb snags very easily and makes it difficult to undo the securing webbing. The barb is also liable to damage.

According to a second aspect of the invention, there is provided an attachment system comprising a support surface provided with a plurality of spaced aligned loops, and a load provided with a plurality of spaced aligned loops, the load loops and the support loops being arranged in an aligned succession to define a path through the loops, and an elongate securing member extending from the load and having a flexible proximal portion and a stiffened distal portion extending from the proximal portion to a free end, the free end of the distal portion being passed through successive support surface loops and load loops along said path in a first direction to draw the proximal portion through said loops in said first direction, to secure the load on the support surface, the distal portion being flexible so that the free end is flexed relative to the remainder of the distal portion to allow the distal portion to be re-inserted into said path and pass along said path in a direction opposite to said first direction to insert the distal portion along the path.

This locks the webbing securely. In addition, it avoids the need to use fasteners to secure the end of the elongate member.

According to a third aspect of the invention, there is provided a load for connection to a support surface and provided with a plurality of spaced aligned loops, the load including a elongate securing member extending from the load and including a flexible proximal portion and a stiffened distal portion, the securing member extending through said loops and, in use, cooperating loops on a support surface to mount the load on the support surface, the distal portion and the proximal portion being of substantially the same length.

According to a fourth aspect of the invention, there is provided a load for connection to a support surface and provided with a plurality of spaced aligned loops, the load including an elongate securing member extending from the load and including a flexible proximal portion and a stiffened distal portion, the securing member extending through said loops and, in use, cooperating loops on a support surface to secure the load on the support surface, the distal portion being resiliently flexible.

The following is a more detailed description of some embodiments of the invention, by way of example, reference being made to the accompanying drawings in which:—

Figure 2:
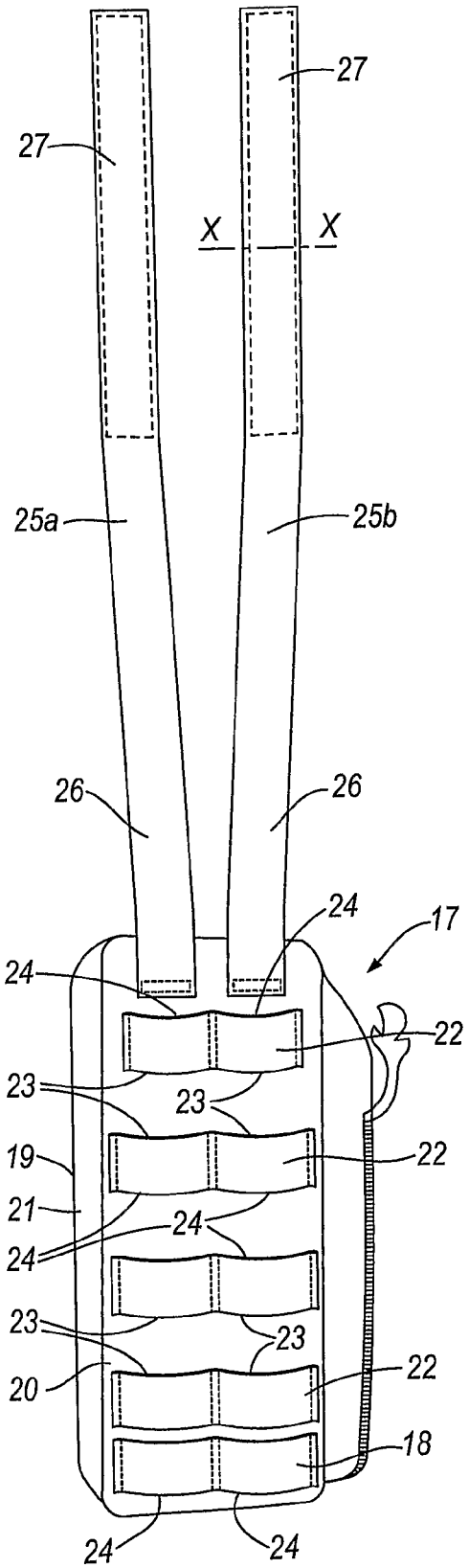
Figure 3:
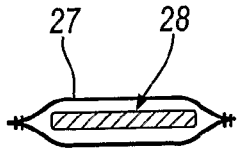
Figure 4:
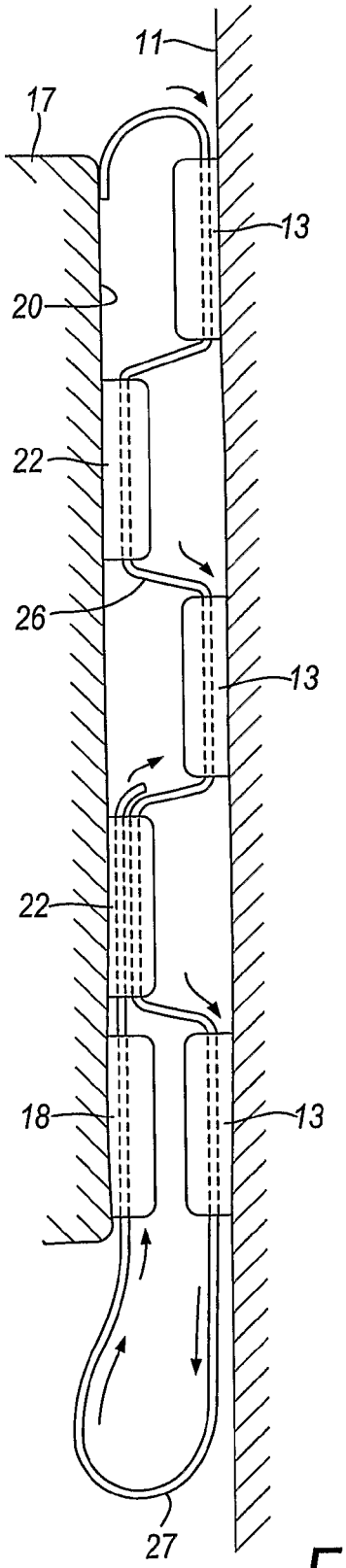
Figure 5:
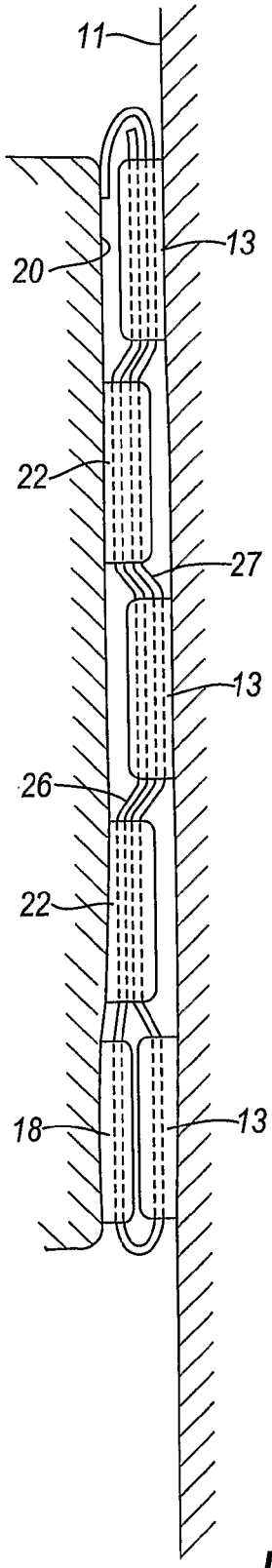
Figure 6:
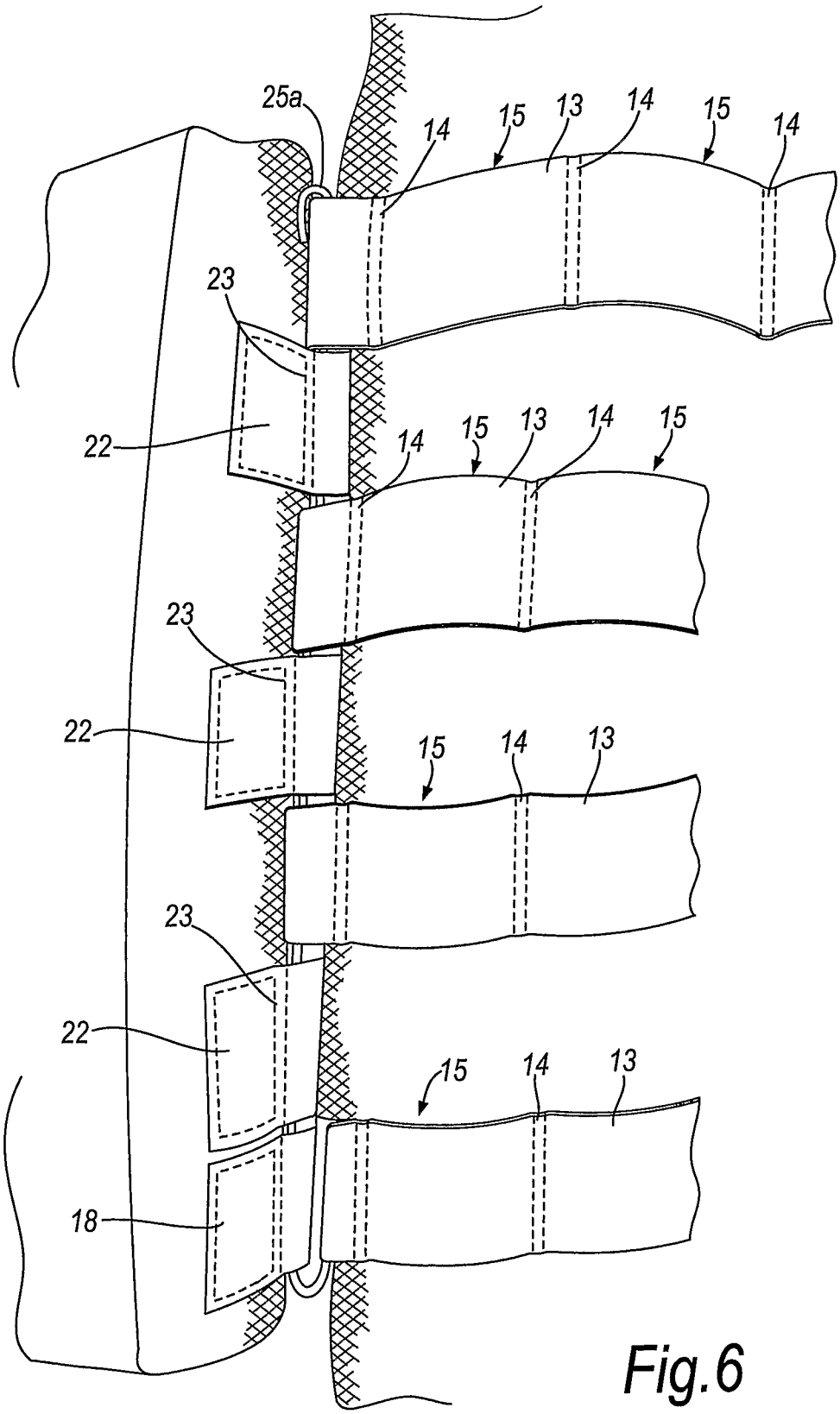
Figure 7:
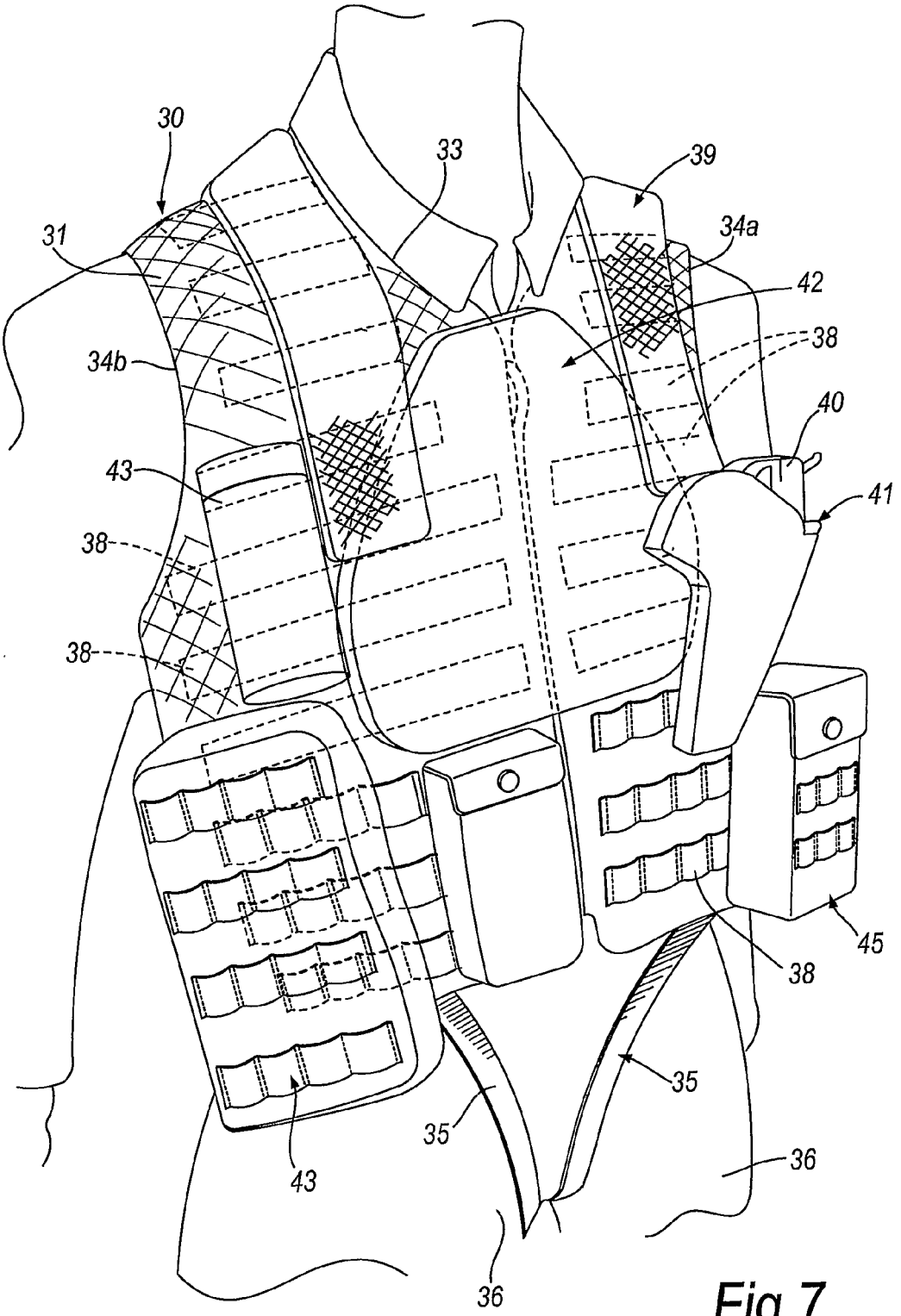
Figure 8:
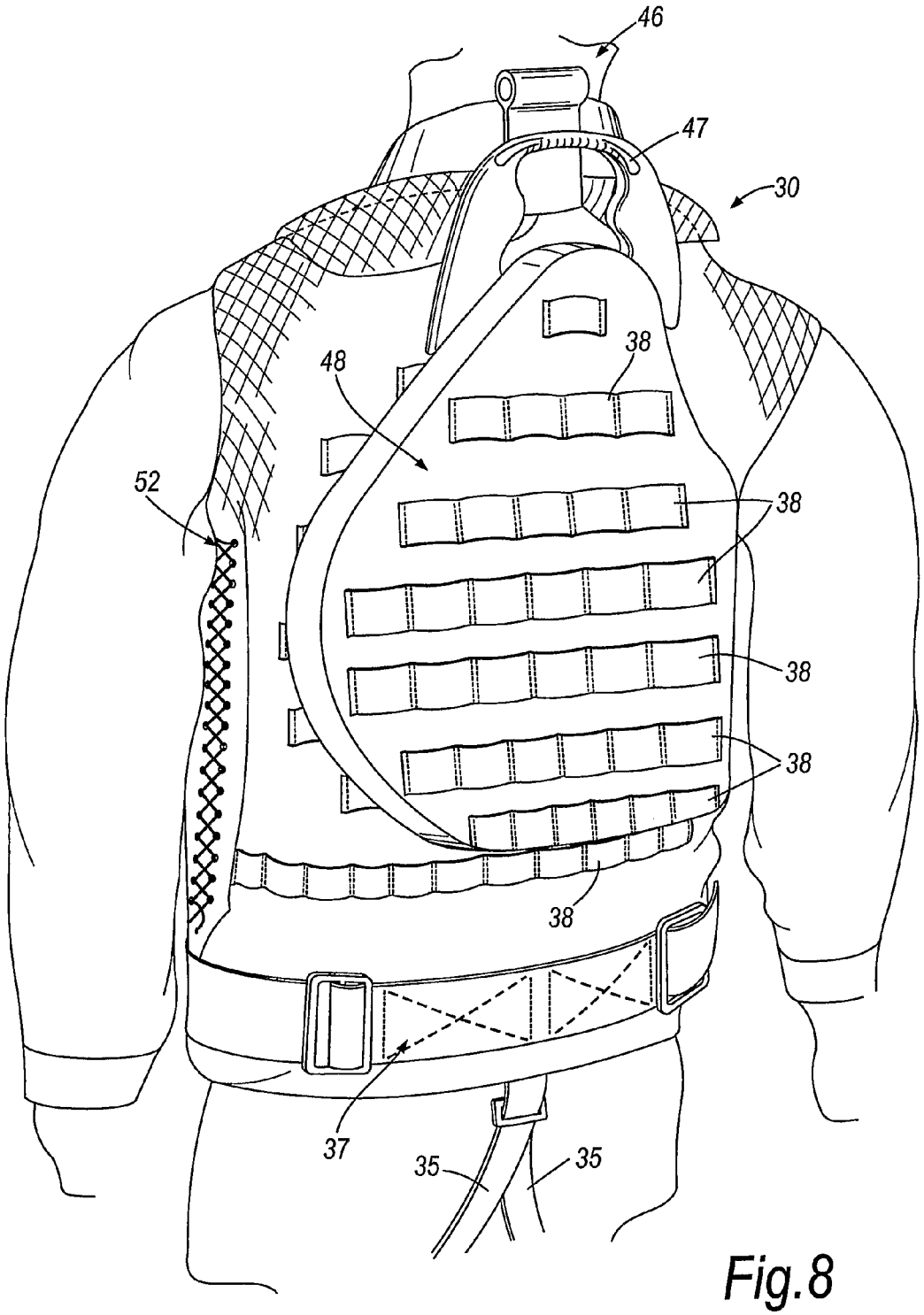

FIG. 1 is a schematic view of a military garment including rows of loops and with an inflatable lifejacket and equipment packs attached to the garment, FIG. 2 is a elevation of an equipment pack having a mounting surface carrying rows of loops and two parallel elongate securing webbings extending from the pack, FIG. 3 is a section on the line X-X of FIG. 2, FIG. 4 is a partial side elevation of the pack of FIG. 2 against the garment of FIG. 1 with the loops of the pack between the loops of the garment and the securing webbings fed through the loops in a first stage of attachment, FIG. 5 is a similar view to FIG. 4 but showing a second stage of attachment, FIG. 6 is a similar view to FIG. 5 but showing the loops on the pack and the garment in more detail, FIG. 7 is diagrammatic view of a carrier vest including rows of loops and various loads attached to the carrier vest, and FIG. 8 is a rear view of the carrier vest of FIG. 7 showing a load attached to the rear of the vest with a load including additional loops for carrying a further load.

FIG. 1 shows an integrated protective ensemble 10 primarily for military use. The basic form of the ensemble may be similar to that described in WO2007/111981A2.

The ensemble 10 has a front panel 11 covering the chest and extending up to the shoulders of a wearer and arms 12. The front panel 11 is formed with a plurality of parallel but spaced lines of webbing 13. One group of lines of webbing 13 is on the left hand side of the front panel 11 and the other group of lines of webbing 13 is on the right hand side of the front panel 11. The right hand lines will be described but it would be appreciated that the left hand lines are similarly formed.

Each line is formed by a length of webbing 13 that may, for example, have a width of about 16 to 25 mm. The lines are spaced by a distance that is similar to or greater than the width of each webbing (16 to 25 mm). Each webbing 13 is connected to the front panel by a number of spaced stitching lines 14. The stitching lines 14 thus form each webbing 13 into a plurality of loops 15 that may have a width of that in the width of the webbing or slightly greater. As seen in FIG. 1, the loops of all the lines are vertically aligned.

The number of loops in a line of webbing 13 depends on the available width of the front panel 11 and it will be seen that, in FIG. 1, this varies from three loops 14 in some lines to seven loops 14 in other lines.

As seen in FIG. 1, the webbings 13 are used to attach loads to the ensemble 10 such as an inflatable lifejacket pack 16 and equipment packs 17.

As described so far, the arrangement is as the known MOLLE system.

One such equipment pack 17 is shown in FIGS. 2 and 3. Referring to those Figures, the equipment pack 17 is of generally rectangular cross-section with a front wall 19 (see FIG. 1) connected to a back wall 20 by a side wall 21. The back wall 20 carries five lines of webbing 22 connected to the back wall 20 by stitching lines 23 to form loops 24. The width of the lines of webbing 22 and the spacing of the stitching lines 22 is as described above with reference to the webbings 13 and the stitching lines 14, with the exception of the lower most line of webbing 18, which abuts the next succeeding webbing 21, for a purpose to be described below.

Two securing webbings 25*a*, 25*b* are attached to an upper end of the back wall 20 of the equipment pack 17 and, in the position shown in FIG. 2, extend in parallel directions that are aligned with the loops 24. Each securing webbing 25*a*, 25*b* has a proximal portion 26 that is formed from unmodified flexible webbing material. The distal portion 27, however, of each securing webbing 25*a*, 25*b* is stiffened so that the distal portion 27 is straight and self-supporting when unloaded.

There are a number of ways in which the requisite stiffness can be achieved. The webbings 25*a*, 25*b* may have a resin or polymer applied to the distal portions 27. Another possibility is shown in FIG. 3 in which an elongate plastics strip 28 is inserted into a pocket formed between layers of the distal portion 27. The distal portion 27 may, in another embodiment, be formed by a double layer of webbing material to give the requisite stiffness. A further possibility is to stitch the distal portion 27 with a stitching pattern that stiffens the distal portion. In a further embodiment, a plastics tube (not shown) may be placed over the distal portion 27 and then shrunk onto the distal portion to provide the necessary stiffness.

In all the embodiments described above with reference to the drawings, the webbings 25*a*, 25*b* are formed from a single contiguous length of webbing that provides both the proximal portion 26 and the distal portion 27. This is not essential. Each webbing 25*a*, 25*b* may be formed in two parts—one part forming the proximal portion 26 and a second part, connected to the first part, forming the distal portion 27. In this case, the distal portion 27 may be formed wholly by a material, such as a plastics strip, that provides the required stiffness.

In preferred embodiments, the stiffness of the distal portion 27 extends all the way to the free end of the distal portion 27. It could end before the free end, although, for some arrangements, this will not be preferred.

However the stiffness is created, the stiffness is such that the distal portion 27 can be flexed, for a purpose to be described below, and will then return back to an unflexed straightened disposition.

The equipment pack 17 is attached to the ensemble 10 in the following way, with reference to FIGS. 4, 5 and 6. First, the back wall 20 of the equipment pack 17 is placed against the front panel 11 of the ensemble 10 so that each webbing 22 on the back wall 20 is located between respective pairs of webbings 13 on the front panel 11. Thus the front panel loops 15 and back wall loops 24 are arranged in an aligned succession to define parallel paths through the loops 15, 24. There is one exception to this, as seen in FIGS. 4, 5 and 6 the lowermost webbing 18 on the back wall 20 is aligned with a webbing 13 on the front panel 11 so that their respective loops are aligned.

Next, the stiffened distal portion 27 of each securing webbing 25*a*, 25*b* is fed through successively through a front panel loop 15 and a back wall loop 24 until the stiffened distal portion 27 emerges from the front panel loop 15 adjacent the lower edge of the equipment pack 17. The stiffness of the distal end 27 right up to the free end makes this a relatively simple task and prevents the free end of the distal portion 27 folding as it is inserted. Since the stiffened distal portion 27 is substantially the same length as the proximal portion 26, which, in turn has of necessity to be of sufficient length to extend through all the aligned loops 15, 24 to allow the proximal portion 26 to extend through one path formed by a succession of aligned loops 15, 24, the part of the distal portion 27 adjacent the proximal portion 26 will still be exposed as the free end of the distal portion 27 is emerging from the lowermost loop Once the distal portion 27 emerges from the lower-most front panel loop 15, the remainder of the securing webbing 24, 28 can be drawn through the path formed by the loops 15, 24 by pulling on the free end until the flexible proximal portion 26 extends through the loops 15 and 24 and the distal portion 27 is beyond the path and hanging freely.

The free end of the distal portion 27 can then be flexed and the free end of the distal portion 27 passed up firstly through the two lowermost loops 24 on the back wall 20 and then through successive front panel loops 13 (see FIG. 4) and back wall loops 22 along the path formed by the loops 15, 24 to lock the end of the securing webbing 25*a*, 25*b*. The resilience of the distal portion 27 causes the distal portion 27 to revert to a straightened or substantially straightened orientation once it has entered the loops 15, 24. This insertion continues until the free end of the distal portion 27 emerges from the uppermost of the back wall loops 15 entered by the webbing 24, 28 (see FIG. 5). Due to the stiffness of the distal portion 27, this provides a geometrical lock for the end of the securing webbing 25*a*, 25*b*. Loads applied to the equipment pack 17, 18 will not result in the webbings releasing.

It will be appreciated that the stiffened distal portion 27 does not need to be exactly the same length as the proximal portion 26 because, as seen in FIG. 5, there is an initial part of the proximal portion 26 that loops over from the attachment point of the associated strap 25*a*, 25*b* into the loops 13, 18, 22. For this reason, the stiffened distal portion 27 may be slightly shorter than the proximal portion 26.

The lifejacket pack 16 may be similarly attached to the ensemble 10.

The ensemble described above with reference to the drawings is intended primarily for use in military environment. There is also, however, a requirement for an attachment system that has wider application. Such an attachment system could be used by persons needing to carry personal equipment that depends on mission requirements. Examples of such persons are soldiers, sailors, aircrew, emergency services, police, paramilitary services and rescue services. The equipment can be selected in accordance with different types of missions or activities that may be determined by, for example, environment (for example, hot weather, cold weather, cold sea), the type of mission (for example, land missions, water missions or air missions), types of warfare (for example, nuclear, biological, chemical or conventional) and types of threats requiring protection (ballistic high velocity, shrapnel low velocity ballistics, shock explosives).

The garment of this type is shown in FIGS. 7 and 8. Referring to those Figures, the garment is in the form of a vest 30 with a front panel 31 (FIG. 7) and a rear panel 32 (FIG. 8). The front and rear panels 31 and 32 define between them a neck opening 33 and left and right arm hole openings 34*a*, 34*b*. At the sides, the front and rear panels 31, 32 are connected by lacing 52 that can be tightened to ensure that the vest is a close fit. Leg straps 35 extend from the lower edges of the front and rear panels 31, 32 and, in use, extend between the legs 36 of a wearer to ensure that the vest 30 does not ride-up on the wearer. In addition, as seen in FIG. 8, a rear belt 37 is provided on the vest 30 to ensure that it fits tightly around the waist of a wearer.

The vest 30 may be made from any suitable material. For example, the vest 30 may be a soft armour vest made from woven KEVLAR™ or having armour plates attached to the inside of the vest 30.

The front panel 31 and the rear panel 32 are provided with webbings 38 constructed and arranged as the webbings 13 described above with reference to FIG. 1. On the front panel 31 the webbings are divided into left and right groups, as in FIG. 1, but on the rear panel 32 the webbings 38 extend across the width of the rear panel 32.

As seen in FIG. 7, the front panel can carry various loads. As shown in this Figure, these may include a lifejacket 39 that can obtain its buoyancy either from foam or from an inflation system and which has an inverted U-shape extending around the back of the neck of the wearer and having the limbs of the U-shape extending down respective sides of the front panel 13. It can include a weapon 40 in a holster 41. It can include a pack containing a hard armour plate 42. It can include a respirator 43, a radio 44 and an ammunition pack 45. All these loads 39, 41, 42, 41, 44, 45 are attached to the front panel 31 in the same manner as the equipment packs 17 described above with reference to FIGS. 1 to 6.

The rear panel 31 carries a winch hoist 46 to allow a wearer to be lifted by a winch and a grab loop 47 that can be gripped by a person in order to pull the wearer. In addition, the rear panel 32 carries a pack 48 containing armour plate 49. The pack 48 is attached to the rear panel 32 in the same way as the equipment packs 17 are attached to the front panel 11 of the ensemble 10 described above with reference to FIGS. 1 to 6. In addition, the pack 48 has an outer surface and is also provided with webbings 51 arranged similarly to the webbing 38 on the rear panel 32. In this way, further loads can be attached to the pack 48. For example, a drinking water pack may be carried on the armour plate pack 48.

Of course, other types of load may be attached to the vest 30. For example, first aid equipment may be attached and survival equipment, such as flares, radio and radio beacons, may be attached. In addition, emergency breathing equipment may be attached or a personal lowering device may be attached.

It will be appreciated that there are a number of modifications that can be made to the ensemble 10 and the vest 30 described above with reference to the drawings. The rows 13, 22 and 38 need not be formed of webbing. They could be formed of any suitable material.

In addition, the loops 15, 24 need not be in rows. There could be a succession of single loops for connecting a single load.

The width of the material forming the webbing rows 13 on the front panel 11 of the ensemble 10 and on the front and rear panels 31, 32 of the vest 30 need not all be of the same width. They could be of different widths. The webbing in the securing webbings 25*a*, 25*b* could be replaced by any suitable material with a stiffened distal portion and a flexible proximal portion. There may be less than two such webbings 25*a*, 25*b* or more than two such webbings 25*a*, 25*b*.

Once the stiffened distal portions 27 of the securing webbings 25*a*, 25*b* have been passed through successive front panel loops 15 and back wall loops 24, the stiffened distal portions 27 could be secured to the front panel 11 or the equipment pack 17, 18 other than by being reinserted through the loops 15, 24 in the opposite direction. Alternatively, the stiffened portion 27 need not be substantially the same length as the proximal portion 26. It could be shorter but still be flexible so that the free end can be flexed relative to the remainder of the distal portion 27 to allow it to be re-inserted into the loops 15, 24.

The invention claimed is:

1. An attachment system comprising a support surface provided with a plurality of spaced aligned loops, and a load provided with a plurality of spaced aligned loops, the load loops and the support loops being arranged in an aligned succession to define a path through the loops, and an elongate securing member extending from the load and having a flexible proximal portion and a stiffened distal portion extending from the flexible proximal portion to a stiffened free end, the stiffened distal portion and the flexible proximal portion being of approximately the same length, the stiffened free end of the stiffened distal portion being passed through successive support surface loops and load loops in a first direction to draw the flexible proximal portion through said loops in said first direction, to secure the load on the support surface, the stiffened distal portion being resiliently flexible so that the stiffened free end is flexed relative to the remainder of the stiffened distal portion to allow the stiffened distal portion to be re-inserted into said path and pass along said path in a direction opposite to said first direction to locate the distal portion along the path such that the stiffened free end is again passed through each of the successive support surface loops and load loops, wherein the length of the stiffened distal portion being such that the stiffened free end of the stiffened distal portion emerges from the path in the first direction before the flexible proximal portion enters the path.

2. A system according to claim 1 wherein the flexible proximal portion and the stiffened distal portion of the or each elongate securing portion is formed from respective portions of a single contiguous member.

3. A system according to claim 1 wherein the flexible proximal portion and the stiffened distal portion of the or each elongate securing portion is formed separately and connected together to form the associated elongate securing portion.

4. A system according to claim 1 wherein the stiffened distal portion extends to the stiffened distal end of each securing member.

5. A system according to claim 1 wherein the stiffened distal portion is formed from an adsorbent material, the stiffened distal portion being treated with a substance to provide said stiffening.

6. A system according to claim 5 wherein said substance is a resin or a polymer.

7. A system according to claim 1 wherein the stiffened distal portion carries an elongate stiffening member to provide said stiffening.

8. A system according to claim 7 wherein the stiffened distal portion is formed with an elongate pocket, the elongate stiffening member being received in said pocket.

9. A system according to claim 7 wherein the stiffened distal portion is received in a plastics tube shrunk onto the stiffened distal portion.

10. A system according to claim 1 wherein the elongate securing member is formed by a webbing.

11. A system according to claim 1 wherein the securing member is one of two or more securing members, each securing member extending in two respective opposite directions through a succession of support surface loops and load loops.

12. A system according to claim 1 wherein the support surface loops are formed by parallel but spaced lengths of material connected to the support surface at spaced intervals, each loop being formed between adjacent connections.

13. A system according to claim 1 wherein the load loops are formed by parallel but spaced lengths of material connected to a load surface at spaced intervals, each loop being formed between adjacent connections.

14. A system according to claim 13 wherein the material is webbing.

15. A system according to claim 1 wherein the or each securing member has a constant width along the length thereof, the spacing between adjacent connections of the material to the associated surface being such that the or each securing member is a close fit in the associated loops.

16. A system according to claim 12 wherein the spacing between the lengths of material on the support surface is equal to the width of the material on the load surface, so that each load surface loop is a close fit between two adjacent lengths of material on the support surface.

17. A load for connection to a support surface and provided with a plurality of spaced aligned loops, the load including an elongate securing member extending from the load and including a flexible proximal portion and a stiffened distal portion, the securing member extending through said loops and, in use, cooperating loops on a support surface to secure the load on the support surface, the cooperating loops on the support surface defining a path, wherein the stiffened distal portion and the flexible proximal portion being of substantially the same length, and wherein the length of the stiffened distal portion being such that a stiffened free end of the stiffened distal portion emerges from the path before the flexible proximal portion enters the path.

18. A load according to claim 17 wherein the spaced aligned loops are provided on a first surface of the load, a second surface separate from said first surface also including a plurality of spaced loops.

19. A load for connection to a support surface according to claim 17 wherein said load is military equipment.

20. A load for connection to a support surface and provided with a plurality of spaced aligned loops, the load including an elongate securing member extending from the load and including a flexible proximal portion and a stiffened distal portion, the securing member extending through said loops and, in use, cooperating loops on a support surface to secure the load on the support surface, the cooperating loops on the support surface defining a path, the stiffened distal portion being resiliently flexible, wherein the length of the stiffened distal portion being such that a free end of the stiffened distal portion emerges from the path before the flexible proximal portion enters the path.

21. A load according to claim 20 wherein the spaced aligned loops are provided on a first surface of the load, a second surface separate from said first surface also including a plurality of spaced loops.

* * * * *